US007665289B2

(12) United States Patent
De Angelis

(10) Patent No.: US 7,665,289 B2
(45) **Date of Patent: *Feb. 23, 2010**

(54) SYNTHETIC FIBER ROPE

(75) Inventor: Claudio De Angelis, Münster (DE)

(73) Assignee: Inventio AG, Hergiswil NW (CH)

( * ) Notice: Subject to any disclaimer, the term of this patent is extended or adjusted under 35 U.S.C. 154(b) by 0 days.

This patent is subject to a terminal disclaimer.

(21) Appl. No.: 11/999,223

(22) Filed: Dec. 4, 2007

(65) Prior Publication Data

US 2008/0148704 A1 Jun. 26, 2008

(30) Foreign Application Priority Data

Dec. 4, 2006 (EP) ..... 06125290

(51) Int. Cl.
*D02G 3/22* (2006.01)

(52) U.S. Cl. ..... 57/250

(58) Field of Classification Search ..... 57/223, 57/238, 241, 244, 250

See application file for complete search history.

(56) References Cited

U.S. PATENT DOCUMENTS

| | | | | |
|---|---|---|---|---|
| 5,834,942 | A * | 11/1998 | De Angelis | 324/522 |
| 2003/0226347 | A1 | 12/2003 | Smith et al. | |
| 2008/0149430 | A1 * | 6/2008 | De Angelis | 187/251 |

FOREIGN PATENT DOCUMENTS

| | | | |
|---|---|---|---|
| EP | 0 731 209 | A | 9/1996 |
| EP | 1 371 597 | A | 12/2003 |
| WO | WO 98/16681 | A2 | 4/1998 |

* cited by examiner

*Primary Examiner*—Shaun R Hurley
(74) *Attorney, Agent, or Firm*—Frase Clemens; Martin & Miller LLC; William J. Clemens

(57) ABSTRACT

A synthetic fiber rope can be used to the limit of failure by setting a sensitivity of detection of the state of wear of the rope. Strands of the rope have indicator fibers or indicator yarn that have a high probability of losing electrical conductivity and thereby indicate cable wear. The matrix of the strand with indicator fibers or with at least one indicator yarn has a lower resistance to abrasion than the matrix of the other strands without indicator fibers or indicator yarns.

10 Claims, 2 Drawing Sheets

SYNTHETIC FIBER ROPE

FIELD OF THE INVENTION

The present invention relates to a synthetic fiber rope consisting of strands that are arranged in at least one layer of strands, a strand consisting of twisted yarns, and a yarn consisting of synthetic fibers, at least one strand having at least one layer of strands of indicator fibers or at least one indicator yarn to monitor the service life of the rope.

BACKGROUND OF THE INVENTION

From Patent Application EP 1 371 597 A1 a sheathed rope used as suspension means for elevators has become known. The rope has inner strand layers and outer strand layers, a strand layer consisting of several twisted strands and the direction of twist of the inner strand layer being opposite to the direction of twist of the outer strand layer. The tensile strength of the inner strand layer is higher than the tensile strength of the outer strand layer. Each strand is constructed of twisted and impregnated aramid synthetic fibers. The service life of the outer strand layer is less than the service life of the inner strand layer. For the purpose of monitoring the rope, individual strands of the outer strand layer are provided with electrically conducting wires, every two adjacent strands being provided with electrically conducting wires that mutually abrade and thereby promptly detect the expiration of the service life of the rope or the end of the rope service life of the rope.

From Patent Application EP 0 731 209 A1 a sheathed rope used as suspension means for elevators has become known. The rope has inner strand layers and outer strand layers, a strand layer consisting of several twisted strands and the direction of twist of the inner strand layer being in the same direction as the direction of twist of the outer strand layer. Each strand is constructed of twisted and impregnated aramid synthetic fibers. For the purpose of monitoring the rope service life or state of wear of the synthetic fiber rope, in each case one strand of a layer of strands is provided with electrically conductive carbon fibers. In regular operation, it is always the case that the carbon fibers, either as a result of excessive stretching or an excessive number of reverse bendings, snap or break sooner than the load-bearing aramid fibers of the strand. With the aid of a voltage source, the number of snapped carbon fibers can be determined. So that the residual load-bearing capacity of the synthetic fiber rope can be assured, only a certain percentage of the carbon fibers may fail. The elevator is then automatically driven to a predetermined stop and switched off.

SUMMARY OF THE INVENTION

It is here that the present invention sets out to provide a remedy. The present invention solves the problem of creating a synthetic fiber rope with increased sensitivity for monitoring the rope service life.

Monitoring of the rope service life is a basic problem of all synthetic fiber ropes, especially such ropes that are surrounded by a sheath.

According to the present state of the art, the carbon fibers can be selected and arranged according to the load situation in the rope. A disadvantage of this method can be that the parameters that should be conditioned cannot be optimally adapted to each other and the suspension means must be replaced too early so as to be sufficiently far away from the critical condition. In elevator construction, synthetic fiber ropes that serve as suspension means can be used up to 60% to 80% of the residual breaking strength relative to the normal breaking strength. The more accurately this point can be reached, the more economically the suspension means can be used.

Depending on the type, field of application, and safety requirements of the synthetic fiber rope application, the requirements for the monitoring sensitivity of the indicator strands of the synthetic fiber rope are increased. Correct responsive behavior and reproducibility depending on the requirement are advantageous characteristics of the synthetic fiber rope according to the invention. It is known that synthetic fiber ropes serving as suspension means for elevators are permanently electrically monitored by means of yarns of carbon fiber that are integrated in the rope strands. This has the advantage that the synthetic fiber ropes are monitored over their entire length including areas that are not visible as, for example, the areas in the rope sockets. The synthetic fiber ropes detect the abrasive wear within the rope and reliably detect damage acting from outside and give the elevator user a maximum of safety through the continuous connection to the elevator control which in case of need can respond quickly and uncompromisingly.

The requirements for a modern monitoring of suspension means have increased relative to the past. So that the synthetic fiber rope can be taken to its limit of failure, and thus the economic potential of the new type of suspension means more fully exploited, or the user can set a sensitivity for detection of the state of wear of the rope that is needed for his requirements, the strands with indicator fibers must be even better adjustable in their response behavior, the indicator fibers of the strands having a high probability of losing their electrical conductivity depending on a number of reverse flexures and residual breaking force and thereby detecting a rope wear.

An indicator fiber or an indicator yarn can be of any material that in any form is conductive, as for example fibers with light-conducting properties or metal coated technical fibers, carbon fibers, etc. that are electrically conductive, the fibers with direct contact wearing sooner than the load-bearing fibers.

For permanent monitoring, the conductive indicator fibers are contacted at the rope end and connected to instruments. At one rope end, the indicator fibers are connected to a signal transmitter and at the other rope end the indicator fibers are connected to a signal receiver. The transmitter signal is measured by means of the signal receiver and the condition of the indicator fibers is evaluated on the basis of the measured or absent signal. EP 0 731 209 A1 shows an example of an indicator fiber monitoring by means of electric signals.

A synthetic fiber rope includes a plurality of twisted strands that are arranged in different layers, each strand consisting of twisted yarns, a yarn consisting of, for example, 1000 synthetic fibers. A matrix material or resin surrounds and/or impregnates the strands of the synthetic fiber rope. A raw yarn consists either of unidirectional synthetic fibers or, for better processability, already has from the factory a protective twist of, for example, 15 turns per meter. In general, "fiber" is used as a length-independent generic term for all textile fiber materials. "Filament" is the term used in chemical fiber manufacturing for textile fibers of great, or virtually endless, length. The direction of twist of the yarn in the strands is so foreseen that the individual fiber is advantageously aligned in the direction of tension of the rope or in the longitudinal axis of the rope. The synthetic fiber rope can be constructed of chemical fibers as, for example, aramid fibers or fibers of related type, polyethylene fibers, polyester fibers, glass fibers, etc. The synthetic fiber rope can consist of one or two or three or more than three layers of strands. At least one strand of at least one layer of strands has indicator fibers or at least one indicator yam for monitoring the rope service life.

According to the present invention, the matrix that surrounds and/or impregnates the strand that is provided with at least one indicator fiber or indicator yarn has a lower resistance to abrasion than the matrix of the other strands.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
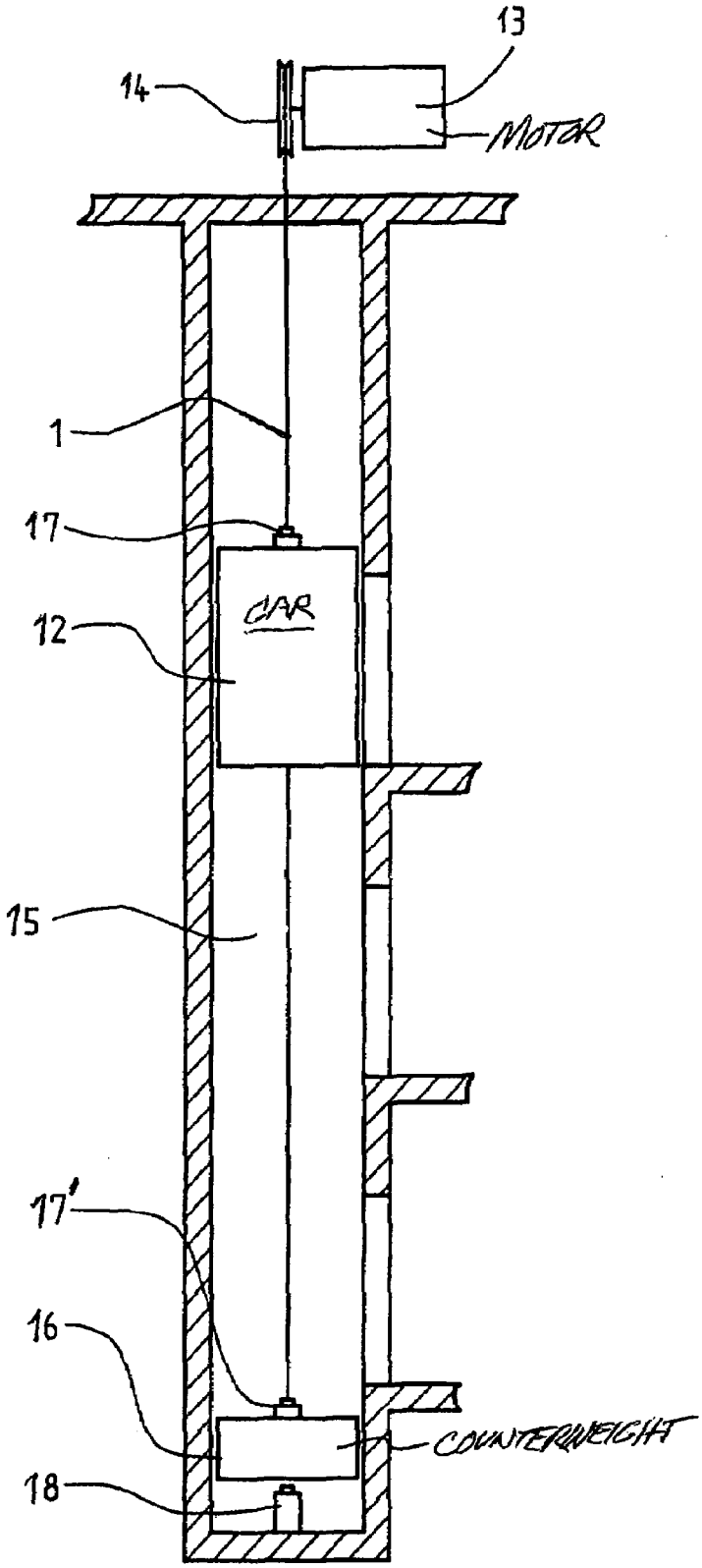
FIG. 1 is a schematic diagram of an elevator system using a synthetic fiber rope according to the present invention.

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

In the synthetic fiber rope according to the present invention, the matrix material or resin that surrounds and/or impregnates the strands with indicator fibers or indicator yarns consists of a softer plastic (for example Shore hardness scale A) than the matrix materials (for example Shore hardness scale D) of the neighboring or other strands, as a result of which these strands relative to a strand without indicator fibers or indicator yarn has a lower resistance to abrasion. As an alternative to the softer plastic, the matrix material can be impregnated with a softener. For this purpose, known softeners can be used. As a result of the poorer abrasion behavior of the strands with indicator fibers, through the movement relative to the adjacent strands that arises during bending, an early onset of wear and thus an earlier failure of the indicator fibers in the strands is provoked. The strand with indicator fibers or indicator yarn acts as the intended breaking point. The strand with indicator fibers or indicator yam is referred to hereafter as "indicator strand". Depending on the type and amount of the selected softener, the increase in wear can be controlled.

Phthalate and adipate are typical softeners that make the strands softer, their lateral rigidity lower, and their resistance to abrasion lower. Through a selected weight ratio of 1% to 30% on the matrix of the indicator strand, the matrix can be executed "softer" relative to the neighboring strands, the abrasion behavior worsening with increasing amount of softener depending on the degree of softness.

Furthermore, the matrix material of the neighboring strand or other strands (strand without indicator fibers or indicator yarn) that is identical to the matrix material of the indicator strands can be impregnated with an additive that reduces the friction relative to the indicator strand. Examples of additive that can be added are waxes or small amounts of Teflon material (1 to 3% wax or 5 to 15% Teflon powder relative to the solid content of the matrix excluding the fiber content).

Further, the matrix material of the indicator strand that is identical to the matrix material of the neighboring strand can be treated during manufacture in such manner that the plastic matrix degrades until the hardness and the wear resistance diminish. This is achieved by a temperature treatment of the indicator strand at a temperature greater than 230° F. and a treatment time of more than 20 seconds. As a result of the temperature, the long molecule chains that are required for the material properties separate to such an extent that on cooling the molecules no longer completely recombine. To support this process, water molecules can be added to the strands matrix, which prevents a complete recombination of the molecule chains. As substitute, other molecules are conceivable that impair or prevent the recombination. An initial degradation of the matrix occurs that causes a sharply lower abrasion resistance and thereby provokes a failure of the indicator fibers or of the indicator yarn. The abrasion protection is caused to deteriorate in targeted manner.

The indicator fibers or indicator yarn are/is located near to the surface of the strand and participate(s) in the spiral structure of the synthetic fibers or of the synthetic fiber yarn. On account of the softer strands matrix, the indicator fibers or the indicator yarn are worn through. The permanent monitoring of the load-bearing strand is thereby interrupted and detected as wear before the other load-bearing strands are affected. This assures that the indicator strands not only have a different performance capacity on account of the different extension to breaking elongation, but also that a reliable failure probability is generated as a result of the different hardness of the matrix. (The breakage extension is the extension of a fiber, a yarn, or a strand until it breaks.)

There is also the further possibility of positioning the indicator strands in a multilayer synthetic fiber rope in such manner that the load that is absorbed is higher than that in the neighboring strands. For example, in a synthetic fiber rope with three strand layers, the two inner concentric strand layers absorb a higher proportion of the load since, although the length of lay relative to the outermost layer is constant, the angle of lay relative to the midpoint of the synthetic fiber rope constantly decreases. In a laid rope, the strands lie significantly steeper, as a result of which the strands are shorter or longer depending on the layer. In view of the geometrical limitation, the innermost strands are the shortest and therefore bear the greater load. It is therefore advisable to arrange further indicator fibers or indicator yarns in individual strands of the two inner strand layers. In the case of a three-layer rope, the middle strand layer is to be preferred since on account of the different wrapping radii and therefore different bending speeds this layer is subject to higher stress loads.

Furthermore, for the strand construction of the strand without indicator fibers a synthetic fiber with very good dynamic reverse bending capacity can be used. For the indicator yarn of the indicator strand the indicator fibers (for example carbon fibers) can be combined with synthetic fibers (for example carbon fibers) whose dynamic reverse bending capacity is inferior to that of the other synthetic fibers of the indicator strands or that of the strand without indicator fibers. The superior synthetic fibers exist for the application of running suspension means on the basis of co-polymers, for example copolyterephthalamide, the under these conditions inferiorly functioning fibers can be of poly-p-phenylenterephthalamide. (The dynamic reverse bending capacity is the reverse bending capacity under changing loads.)

Furthermore, for the construction of the indicator yarn, the indicator fibers (for example carbon fibers) can be combined with synthetic fibers which, relative to the other synthetic fibers of the indicator strand or relative to the synthetic fibers of the strand without indicator yarn, have a higher modulus of elasticity. For the synthetic fibers that are combined with the indicator yarns in the indicator strands Twaron (registered trademark) fibers, for example, with a modulus of elasticity of 100,000 to 120,000 N/mm$^2$ can be used. The other fibers of the non-indicator strands can consist of, for example, Technora (registered trademark) fibers with 76,000 N/mm$^2$. Twaron fibers and Technora fibers are manufactured by Teijin Aramid BV, the Netherlands.

The aforementioned measures to monitor the rope service life can also be combined. For example, the resistance to abrasion can be provided by changing the strands matrix and, at the same time, the indicator yarn can consist of indicator fibers and synthetic fibers that in relation to stress are inferior to the other synthetic fibers.

FIG. 1 shows an elevator installation incorporating a synthetic fiber rope 1 according to the present invention. An elevator car 12 is suspended from one end of the rope 1. A motor 13 drives a traction sheave 14 that engages the rope 1 and moves the car 12 vertically in an elevator shaft 15. An opposite end of the rope 1 is attached to a counterweight 16 in the shaft 15. A signal transmitter 17 is connected to the end of the rope 1 at the car 12 and a signal receiver 17' is connected to the end of the rope 1 at the counterweight 16. The positions of the signal transmitter 17 and the signal receiver 17' can be reversed and they cooperate to detect the condition of the indicator fibers by the presence or absence of a signal generated by the transmitter through the indicator fibers to the receiver. A buffer 18 is provided in the bottom of the shaft 15.

Figure 2:
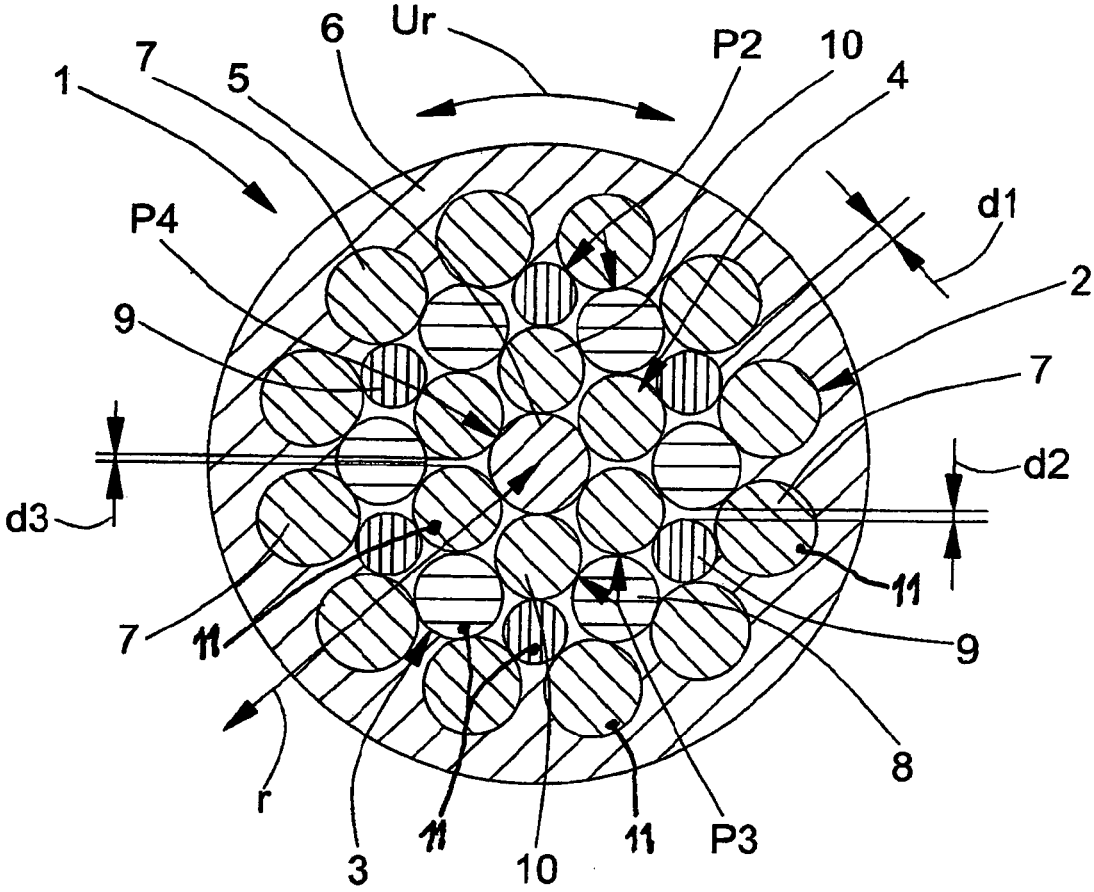
FIG. 2 is a schematic cross-sectional view of the rope shown in FIG. 1.

FIG. 2 shows the synthetic fiber cable 1 according to the present invention. The synthetic fiber cable 1 comprises several strand layers, an outer strand layer 2, a first inner strand layer 3, a second inner strand layer 4 and a core layer 5. A cable sheathing is denoted by 6. Construction and diameter of the strands 7 of the outer strand layer 2 are identical. The first inner strand layer 3 consists of, in diameter, larger strands 8 and smaller strands 9. The larger strands 8 approximately correspond in diameter with the strands 10 of the second inner strand layer 4 and of the core strand 5. The strands 7 of the outer strand layer 2 are larger in diameter than the larger strands 8 of the first inner strand layer 3 and of the strands 10 of the second inner strand layer 4. The larger strands 8 of the first inner strand layer 3 are larger in diameter than the smaller strands 9 of the first inner strand layer 3. The strands 10 of the second inner strand layer 4 are stranded around the core strand 5, the strands 8, 9 of the first inner strand layer 3 are stranded around the second strand layer 4 and the strands 7 of the outer strand layer 2 are stranded around the first inner strand layer 3. FIG. 2 is similar to FIG. 1 of co-pending application Ser. No. 11/863,401 filed on Sep. 28, 2007 incorporated herein by reference.

Indicator fibers or yarns 11 can be provided in any of the strands of any of the strand layers. For example, as shown in FIG. 2, one or more of the strands 7 of the outer strand layer 2 can include the fibers or yarns 11, one or more of the strands 8 and 9 of the first inner strand layer strand layer 3 can include the fibers or yarns 11, and one or more of the strands 10 of the second inner strand layer 4 can include the fibers or yarns 11.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A synthetic fiber rope having strands that are arranged in at least one strand layer, a strand including twisted yarns of synthetic fibers and a matrix, the synthetic fiber rope comprising:

at least one strand of the at least one strand layer having indicator fibers or at least one indicator yarn, wherein the matrix of the strand with said indicator fibers or with said at least one indicator yarn has a lower resistance to abrasion than the matrix of the other strands of the synthetic fiber rope for monitoring a service life of the synthetic fiber rope.

2. The synthetic fiber rope according to claim 1 wherein the matrix of the strand with said indicator fibers or with said at least one indicator yarn is impregnated with softener.

3. The synthetic fiber rope according to claim 1 wherein the matrix of the strand with said indicator fibers or with said at least one indicator yarn has a lower Shore hardness than a Shore hardness of a matrix of an adjacent strand or another strand of the rope.

4. The synthetic fiber rope according to claim 1 wherein the matrix of the strand with said indicator fibers or with said at least one indicator yarn is degraded by at least one of heat treatment and an addition of molecules of another material.

5. The synthetic fiber rope according to claim 1 wherein a matrix of at least one strands without said indicator fibers or without said at least one indicator yarn is impregnated with an additive that reduces a friction relative to the strands with said indicator fibers or with said at least one indicator yarn.

6. The synthetic fiber rope according to claim 1 wherein said at least one strand with said indicator fibers or with said at least one indicator yarn is positioned in the rope to have a higher load absorption relative to adjacent fibers in the rope.

7. A method for monitoring a rope service life of a synthetic fiber rope according to claim 1 including a step of permanently monitoring the strands utilizing the indicator fibers.

8. The method according to claim 7 including monitoring the indicator fibers by connecting the indicator fibers at one end of the rope to a signal transmitter, connecting the indicator fibers at an opposite end of the rope to a signal receiver, generating a transmission signal from the signal transmitter, monitoring for the transmission signal with the signal receiver, and on the basis of a presence or absence of the transmission signal at the signal receiver evaluating a condition of the indicator fibers.

9. The method according to claim 8 including monitoring of the indicator fibers by generating optical signals or electric signals as the transmission signal.

10. An elevator installation with a synthetic fiber rope according to claim 1 connected to an elevator car.

* * * * *